United States Patent [19]

Thompson

[11] Patent Number: 4,517,758

[45] Date of Patent: May 21, 1985

[54] LIGHT BULB ATTACHED SIGN ASSEMBLY

[76] Inventor: Marion E. Thompson, 2807 N. Prospect St., Colorado Springs, Colo. 90907

[21] Appl. No.: 142,995

[22] Filed: Apr. 23, 1980

Related U.S. Application Data

[63] Continuation-in-part of Ser. No. 030,608, Apr. 11, 1979, Pat. No. 4,227,327.

[51] Int. Cl.[3] ..... G09F 13/30

[52] U.S. Cl. ..... 40/431; 40/617; 40/473; 136/291

[58] Field of Search ..... 136/291, 89 H; 40/431, 40/473, 558, 617

[56] References Cited

U.S. PATENT DOCUMENTS

| | | | |
|---|---|---|---|
| 1,913,150 | 6/1933 | Atwater | 40/473 |
| 2,796,688 | 6/1957 | Van Pragg | 40/558 |
| 2,928,198 | 3/1960 | Madanick | 40/558 |
| 3,031,784 | 5/1962 | Stein | 40/617 |
| 3,231,995 | 2/1966 | Anthony | 40/473 |
| 3,964,189 | 6/1976 | Belokin | 40/538 |
| 4,201,012 | 5/1980 | Marshall | 46/256 |
| 4,207,696 | 6/1980 | Hyman et al. | 40/473 |

FOREIGN PATENT DOCUMENTS

| | | | |
|---|---|---|---|
| 714756 | 8/1965 | Canada | 40/473 |
| 841259 | 6/1952 | Fed. Rep. of Germany . | |
| 587837 | 5/1947 | United Kingdom . | |
| 717054 | 10/1954 | United Kingdom . | |
| 1075139 | 7/1967 | United Kingdom . | |

OTHER PUBLICATIONS

Edmund Scientific Co. Catalog #7975; Spring, 1978; p. 1979.

Solarex Corporation Sep. 1978—"The Solarex Sunflower" Be Ready for the solar age.

*Primary Examiner*—Gene Mancene
*Assistant Examiner*—Wenceslao J. Contreras
*Attorney, Agent, or Firm*—Cushman, Darby & Cushman

[57] ABSTRACT

An assembly for the merchandizing of products utilizing a solar cell mounted directly onto an incandescent or florescent light bulb so that the cell receives the light directly from the light bulb. A d.c. motor is electrically and physically connected to the solar cell, the motor shaft extending downwardly. A substantially planar sign member having word indicia formed thereon is operatively interconnected to the motor shaft so that it rotates in response to motor shaft rotation. The interconnection preferably is provided by a piece of metal foil extending vertically and attached to the motor shaft, and a slip swivel connector between the metal foil and the sign member which allows some slippage between the foil and the sign member so that the sign member rotates more slowly than the foil—slow enough for appropriate normal recognition of the word indicia thereon. A plurality of flexible clips may be provided for mounting the solar cell directly to the light bulb, or globe for the light bulb. Alternatively, a fan blade may be mounted to the motor shaft.

17 Claims, 6 Drawing Figures

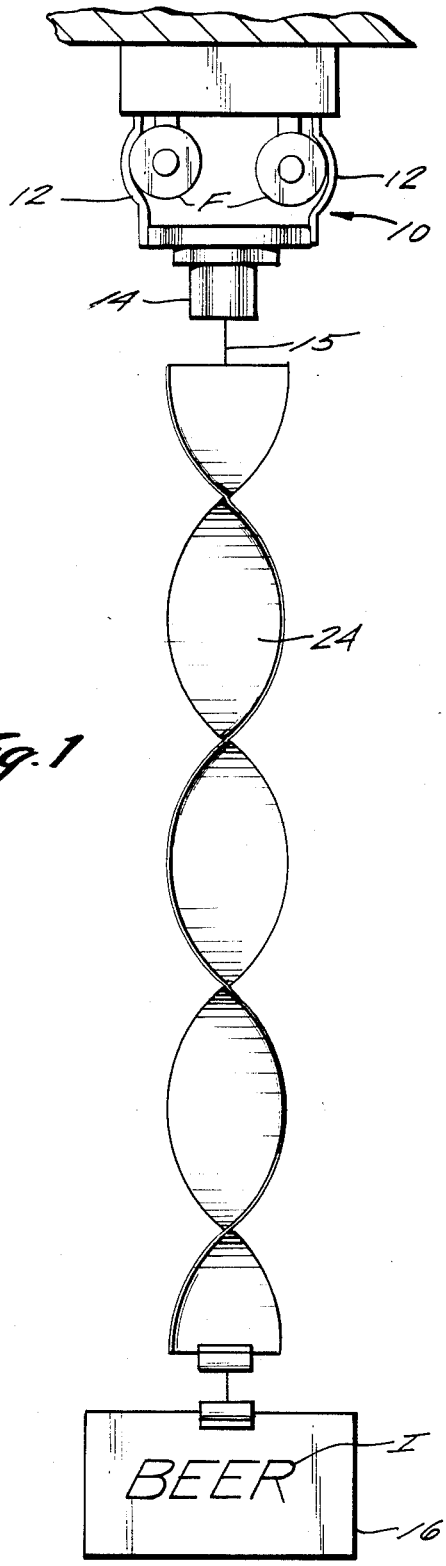
Fig. 1
Fig. 2
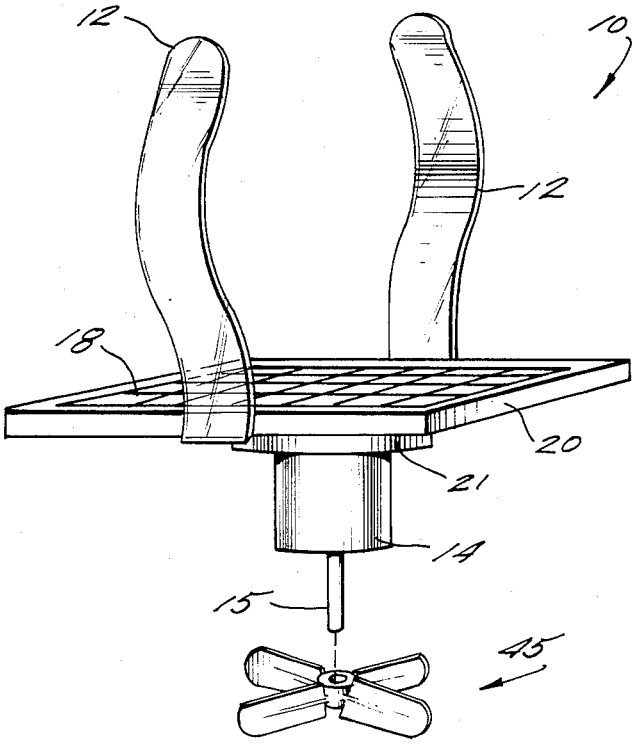
Fig. 6
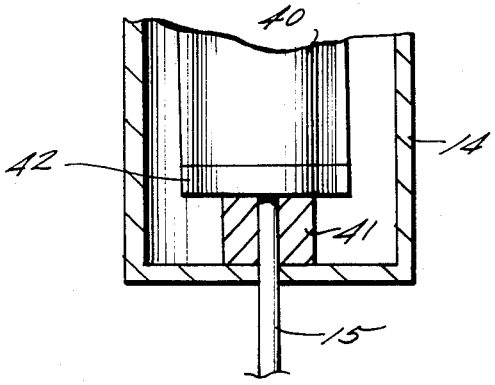

LIGHT BULB ATTACHED SIGN ASSEMBLY

CROSS REFERENCE TO RELATED APPLICATION

This application is a continuation-in-part of my application Ser. No. 30,608 filed Apr. 11, 1979, now U.S. Pat. No. 4,227,327 the disclosure of which is hereby incorporated by reference herein.

BACKGROUND AND SUMMARY OF THE INVENTION

For the merchandising of products, and for providing conversation pieces in homes and offices, it is desirable to utilize simple attention capturing devices. While it is desirable that such devices be simple, it is also often desirable that some sort of a gimmick or unusual feature be associated with the display to attract and hold a viewer's interest. One such assembly for doing that is illustrated and described in my copending application Ser. No. 30,608 filed Apr. 11, 1979 now U.S. Pat. No. 4,227,327. The devices illustrated therein are useful for may different types of display assemblies, but for some retail establishments and for some types of products they do not achieve optimum attraction and holding of a viewer's interest. The assembly according to the invention is designed to provide for optimum attention getting and holding in such situations.

The display assembly according to the present invention is adapted to be mounted directly on a light bulb and receive the motive power therefor from the light bulb. Mounting may be directly to an incandescent light bulb, one or more florescent light bulbs, or globes associated with such light sources, etc. When the light bulb is activated the display is thus automatically activated, and since it hangs down from the light bulb and has an associated hanging sign member with word indicia thereon associated therewith, it provides an effective attention getting and holding assembly; yet it is simple, inexpensive, and reliable, being suitable as a point of purchase display item, conversation piece, or novelty item.

The assembly according to the present invention comprises a solar cell, means for mounting the solar cell directly onto a light bulb so that the cell receives light directly from the light bulb, and a d.c. motor electrically connected to the solar cell and physically attached to the cell and extending from the opposite side thereof as the mounting means, the motor having a shaft. The assembly further may comprise a substantially planar sign member having word indicia thereon, and means for operatively interconnecting the sign member to the motor shaft to rotate in response to motor shaft rotation.

Preferably, the d.c. motor is of an inexpensive type that normally rotates its shaft at a speed too fast for normal recognition of the word indicia on the sign member. However, the area of the sign member is chosen, and the means for interconnecting the sign member to the motor shaft are constructed, so that the sign member rotates at a speed (slower than the motor shaft) appropriate for normal recognition of the word indicia on the sign member. The interconnecting means, in order to maximize the attention-getting function of the assembly, preferably comprises a piece of metal foil which, during rotation, assumes generally a helix configuration; means for attaching the metal foil to the motor shaft; and means for connecting the metal foil to the sign member so that some slippage is provided between the metal foil and the sign member as the sign member rotates in response to rotation of the metal foil, so that the sign member rotates at a slower speed than the metal foil. Such connecting means preferably comprises a slip swivel connector.

The means for mounting the solar cell directly on a light bulb preferably comprises a plurality of flexible clips attached to spaced portions of the solar cell and dimensioned to receive a light bulb or light bulbs therebetween. When utilized with a florescent light bulb the solar cell may be substantially quadrate in plan while when utilized with an incandescent bulb it may be substantially circular in plan. A light pickup lens may be disposed on the solar cell between it and the light bulb, and a base for the solar cell may include a holding means for the d.c. motor formed thereon and extending in opposite direction as the clips.

The assembly according to the present invention also is very versatile, and with minor adaptations can be used to provide circulation of air within the room in which it is used. In particular, warm air tending to rise toward the ceiling can be circulated back down to the floor area by merely mounting a fan blade on the d.c. motor shaft instead of the sign member and associated structures. With such an arrangement the d.c. motor preferably will be designed so that it rotates at about 100 to 300 rpm, and has a large number of commutating positions for easy start up. The clips mounting the solar cell preferably are transparent in this modification. Utilizing such an assembly it is possible—without any energy input besides that provided by a light bulb (even a florescent light bulb) to effect circulation of air within a room.

It is the primary object of the present invention to provide a simple attention-getting and holding display assembly, and one that is versatile so that it can be adapted for use in circulating air from a light bulb area to other portions of a room. This and other objects of the invention will become clear from an inspection of the detailed description of the invention and from the appended claims.

BRIEF DESCRIPTION OF THE DRAWINGS

FIG. 1 is a side view of an exemplary display assembly according to the present invention operatively connected to a pair of florescent light bulbs;

FIG. 2 is a detailed perspective view of the solar cell module of FIG. 1, and a fan blade that may be utilized therewith;

FIG. 6 is a side detailed view, partly in cross-section and partly in elevation, of a particular internal configuration that may be utilized for the d.c. motor of the assembly according to the invention.

DETAILED DESCRIPTION OF THE DRAWINGS

Figure 3:
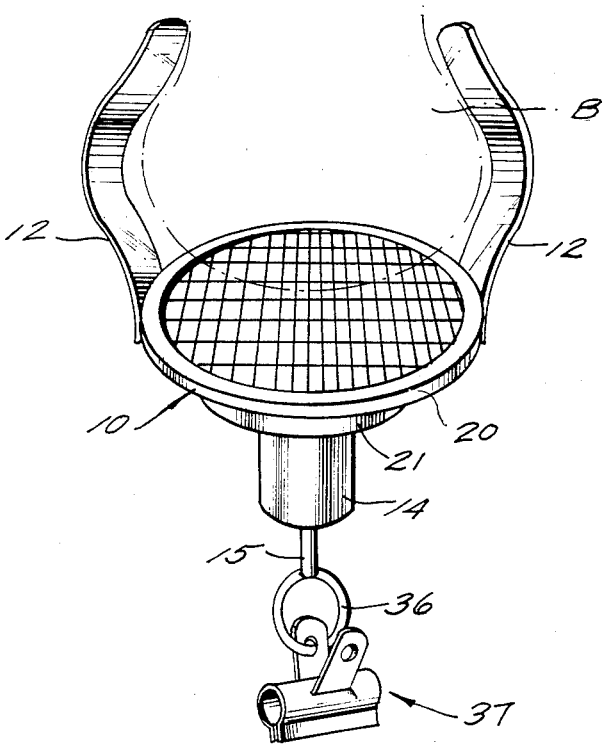
FIG. 3 is a modified form of solar cell module according to the present invention.

The exemplary assembly according to the present invention illustrated in the drawings includes a conventional solar cell 10, means for mounting the solar cell directly onto a light bulb so that the cell receives light directly from the light bulb, such as the flexible clips 12, and a conventional, inexpensive d.c. motor 14 electrically connected to the solar cell 10 and physically attached to the cell and extending from the opposite side thereof as the clips 12, the motor having a shaft 15. The assembly further preferably includes a substantially planar sign member 16 having word indicia I thereon, and means for operatively interconnecting the sign member 16 to the motor shaft 15 to rotate in response to motor shaft rotation.

As illustrated in FIGS. 2 and 3, the solar cell 10 may take a variety of forms, and a conventional light pickup lens 18 may be disposed thereon between it and the light bulb to which it is mounted. The solar cell 10 peferably comprises a base 20 with the clips 12 attached to opposite sides of the base, and with a means 21 for receiving the motor 14 integral with the base 20 and extending from the opposite end thereof as the clips 12. The clips 12 may be made of metal or of plastic that will not melt or lose its desirable properties if in contact with the light bulb, and preferably are transparent.

The modification of the solar cell module illustrated in FIG. 2 is particularly adapated for use with florescent light bulbs, such as the florescent bulbs F in FIG. 1. At least one florescent bulb F is received between the clips 12, with the solar cell having a quadrate in plan configuration to take maximum advantage of the light emanating from the florescent bulb or bulbs F. In the exemplary version of the invention illustrated in FIG. 3 the solar cell 10 is circular in plan, this version being particularly adapted for use with an incandescent light bulb, the clips 12 receiving the incandescent light bulb therebetween. The incandescent bulb is shown in dotted line at B in FIG. 3.

The wires for interconnecting the solar cell 10 to the motor 14 may, of course, be provided passing through the base 20 through the motor holding means 21 directly to the motor 14. The motor 14 being an inexpensive type, has no gearing associated therewith and normally rotates the shaft 15 so quickly that a sign member attached thereto would rotate too fast for recognition of word indicia thereon. In order that the word indicia I on the sign member 16 be properly recognized when utilized in the assembly, the area of the sign member 16 is chosen and the means for interconnecting the sign member 16 to the motor shaft 15 is constructed so that the sign member rotates at a speed, slower than the motor shaft, appropriate for normal recognition of the word indicia on the sign member.

The preferred form that means for interconnecting the sign member 16 to the motor shaft 15 takes is illustrated in the drawings, and includes a strip 24 of metal foil; means 26 (see FIG. 4) for connecting the metal foil to the sign member 16 so that some slippage is provided between the metal foil and the sign member as the sign member rotates in response to rotation of the metal foil so that the sign member rotates at a slower speed that the metal foil 24; and means 27 (see FIG. 3) for attaching the metal foil 24 to the motor shaft 15.

Figure 4:
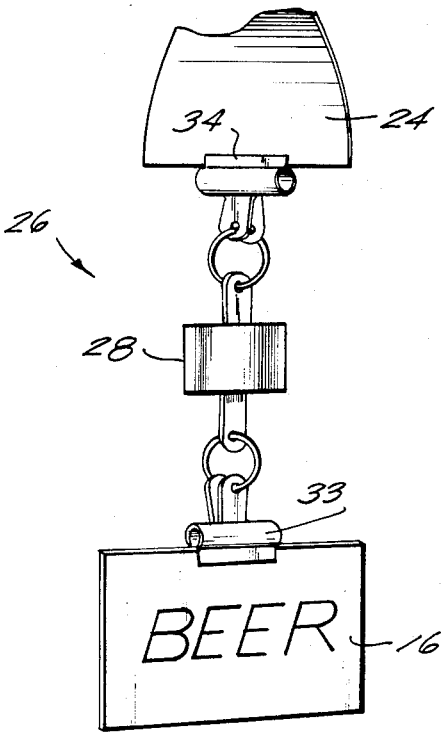
FIG. 4 is a detailed perspective view of the interconnection of the sign member to other components of the FIG. 1 assembly.
Figure 5:
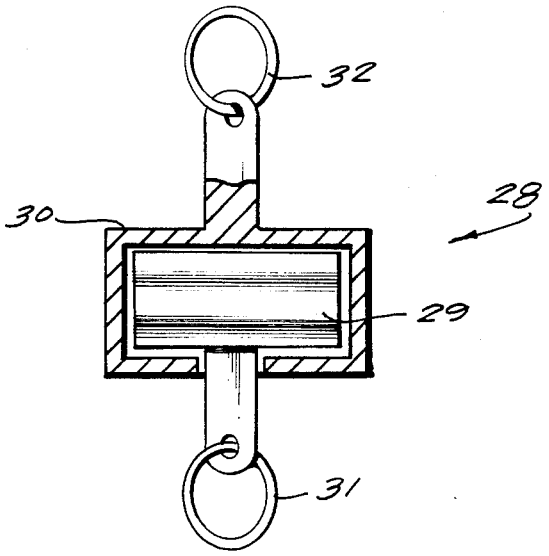
FIG. 5 is a side view partially in cross-section and partially in elevation of the slip swivel connector of FIG. 4.

The means 26 preferably includes a conventional slip swivel connector 28 (see FIGS. 4 and 5), the slip swivel connector 28 including an interior component 29 relatively loosely received by an outer component 30, enought interference being provided between the components 29, 30 so that rotation of one effects rotation of the other but allows some slippage therebetween so that the driven one rotates at a slower speed than the drive one. Eyelets 31, 32 may be connected to the swivel connector 28, which may be passed through openings in tension clips 33, 34 (see FIG. 4) which are in turn easily clipped to the bottom of the foil 24 in the top of the sign member 16. The structure illustrated in FIG. 4 provides a structure that is easy to assemble and provides for ready changing of the sign member 16 and foil 24.

The foil 24 may be connected to the shaft 15 in any suitable manner (including by providing the slip swivel connector therebetween instead of between the foil and the sign member). The form 27 of the connecting means illustrated in FIG. 3 includes an eyelet 36 welded, screwed, or clamped to the shaft 15, with a tension clip 37 connected to the eyelet 36. The tension clip 37 may be clamped onto the top of the foil 24.

Since some weight will be hanging on shaft 15, it is desirable to construct the d.c. motor 14 to accommodate this. FIG. 6 schematically illustrates a modification of a d.c. motor that takes the weight-supporting function of the shaft 15 into account. The motor 14 includes a convention armature 40 and front motor bushing 14, and according to the invention a washer 42 of Teflon (or like material having Teflon's friction and lubricating properties) is disposed between the armature 40 and motor bushing 41.

The assembly according to the present invention also is versatile and can be utilized for other purposes. For instance, as illustrated in FIG. 2, a conventional fan blade (such as even a conventional plastic propellor blade from model airplanes) 45 may be mounted on the shaft 15 instead of the foil 24, sign 16, etc. The assembly then acts to circulate air from the volume surrounding the light bulb to which it is clipped to other areas of the room. For instance, when the clips 20 are connected to florescent bulbs F on a ceiling, the fan blade 45 will circulate the warm air from adjacent ceiling back down to the floor area, a very gentle circulation being provided. When the motor 14 is to be primarily used for that purpose it is preferably designed so that its normal speed of rotation is 100 to 300 rpms, and preferably it has a large number (i.e., more than 3) commutating positions so that it will start easily even when florescent light bulbs supply the energy. Utilizing such an arrangement it is possible to provide for general circulation of air in a room without any extra energy input, conventional light sources providing the input, and the assembly is totally unobtrusive.

In use of the assembly according to the present invention, normally the solar cell 10, with base 20, will be formed as an integral unit with the clips 12 and motor mounting means 21, and the motor 14 will be prewired and preattached to the base 20. This provides a module, such as illustrated in FIGS. 2 and 3.

To utilize the module for a display, the clips 12 are simply clipped over the light bulb(s) (e.g., F in FIG. 1), the tension clip 37 clips the top of the foil 24 to the shaft 15, the tension clip 34 clips the swivel connector 28 to the bottom of the foil 24, and the tension clip 33 clips the sign member 16 to the swivel connector 28. When the light bulbs are turned on, light received by the solar cell 10 drives the d.c. motor 14. The rotation of the motor shaft 15 causes the foil stip 24 to assume a generally helical configuration (as illustrated in FIG. 1), and as a result of slippage at the slip connector 28 and the area of the sign member 16, the sign member 16 will be caused to rotate at a speed lower than the speed of rotation of the shaft 15. The speed of rotation of the sign member 16 will be slow enough so that the word indicia I thereon is readily normally recognizable.

It will thus be seen that according to the present invention a simple to construct and use, yet efficient and effective display-getting and holding assembly has been provided that also may function to circulate air from a light source. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and assemblies.

What is claimed is:

1. An assembly comprising:

a solar cell;

means for mounting said solar cell directly onto a light bulb so that said cell receives light directly from the light bulb;

a d.c. motor electrically connected to said solar cell and physically attached to said cell and extending from the opposite side thereof as said means for mounting said means for mounting said cell to the light bulb, said motor having a shaft;

a substantially planar sign member having word indicia thereon; and means for operatively interconnecting said sign member to said motor shaft to rotate in response to motor shaft rotation, said means including a slip swivel connector.

2. An assembly comprising:

a solar cell;

means for mounting said solar cell directly onto a light bulb so that said cell receives light directly from the light bulb;

a d.c. motor electrically connected to said solar cell and physically attached to said cell and extending from the opposite side thereof as said means for mounting said means for mounting said cell to the light bulb, said motor having a shaft;

a substantially planar sign member having word indicia thereon; and means for operative interconnecting said sign member to said motor shaft to rotate in response to motor shaft rotation, comprising: a piece of metal foil; means for attaching said metal foil to said motor shaft; and means for connecting said metal foil to said sign member so that some slippage is provided between said metal foil and said sign member as said sign member rotates in response to rotation of said metal foil so that said sign member rotates at a slower speed than said metal foil; and wherein said d.c. motor normally rotates its shaft at a speed too fast for normal recognition of the word indicia on said sign member; and wherein the area of said sign member is chosen and said means for interconnecting said sign member to said motor shaft is constructed so that said sign member rotates at a speed, slower than the motor shaft, appropriate for normal recognition of the word indicia on said sign member.

3. An assembly as recited in claim 2 wherein said means for connecting said metal foil to said sign member includes a slip swivel connector.

4. An assembly as recited in claim 3 wherein said means for connecting said metal foil to said sign member further includes a tension clip connecting said metal foil to said slip swivel connector, and a tension clip connecting said sign member to said slip swivel connector.

5. An assembly as recited in claims 2 or 1 wherein said means for mounting said solar cell directly on a light bulb comprises a plurality of flexible clips operatively attached to spaced portions of said solar cell and dimensioned to receive at least one florescent bulb therebetween.

6. An assembly as recited in claim 5 wherein said solar cell includes a base, and wherein said base includes a holding means for said d.c. motor formed thereon extending oppositely from said clips.

7. An assembly as recited in claim 5 wherein said solar cell is substantially quadrate in plan.

8. An assembly as recited in claims 2 or 1 wherein said means for mounting said solar cell directly on a light bulb comprises a plurality of flexible clips operatively attached to spaced portions of said solar cell and dimensioned to receive an incandescent light bulb therebetween.

9. An assembly as recited in claim 8 wherein said solar cell includes a base, and wherein said base includes a holding means for said d.c. motor formed thereon extending oppositely from said clips.

10. An assembly as recited in claim 8 wherein said solar cell is substantially circular in plan.

11. An assembly as recited in claim 2 wherein said solar cell includes a light pickup lens disposed thereon between it and said light bulb.

12. An assembly as recited in claim 2 or 1 combination with a light bulb, said solar cell mounting means attached to said light bulb so that said motor shaft points substantially downwardly and said metal foil extends substantially vertically.

13. An assembly as recited in claims 2 or 1 wherein said d.c. motor includes an armature and front motor bushing, and a Teflon washer disposed between the motor armature and front motor bushing, said shaft passing through said washer and bushing.

14. An assembly comprising a base; a d.c. motor mounted in said base and surrounded thereby, said motor having a shaft; a solar cell; means for operatively connecting the solar cell to the base while providing electrical interconnection between the cell and the motor; a sign member having a substantially planar surface with word indicia formed thereon; an elongated shaft-like member operatively connected to the sign member and elongated in a plane substantially coincident with or parallel to the sign member planar surface; means for interconnecting the sign member shaft-like member and the motor shaft so that the motor shaft rotates the sign member with respect to the base when incident radiation of sufficient intensity strikes the solar cell; said d.c. motor normally rotating its shaft at a speed too fast for normal recognition of the word indicia on said sign member; and the area of said sign member being chosen and said means for interconnecting said sign member shaft-like member and said motor shaft means so constructed that said sign member rotates at a speed, slower than the motor shaft, appropriate for normal recognition of the word indicia on said sign member; wherein the improvement comprises:

said shaft-like member operatively connected to said sign member including a slip swivel connector, and a piece of metal foil, said piece of metal foil and said slip swivel connector operatively disposed between and connected to said motor shaft and said sign member.

15. An assembly; including a d.c. motor and a solar cell module, said module including a base; a solar cell disposed on said base; means for stationarly mounting said base directly onto a light bulb so that said cell receives light directly from the light bulb and said mounting means extends from one side of said base; and means for mounting said d.c. motor to said base so that said motor shaft extends away from said base and oppositely of said base mounting means.

16. An assembly as recited in claim 15 wherein said d.c. motor includes an armature and front motor bushing, and a Teflon washer disposed between the motor armature and front motor bushing, said shaft passing through said washer and bushing.

17. An assembly as recited in claim 16 wherein said means for mounting said base directly on a light bulb comprises a plurality of flexible clips attached to spaced portions of said base and dimensioned to receive an incandescent light bulb therebetween.

* * * * *